United States Patent [19]

Kunz

[11] 4,393,535

[45] Jul. 19, 1983

[54] ADJUSTABLE BRUSH

[76] Inventor: Paul Kunz, Bern, Id. 83220

[21] Appl. No.: 244,748

[22] Filed: Mar. 17, 1981

[51] Int. Cl.[3] ..... A46B 9/10

[52] U.S. Cl. ..... 15/169; 15/104.18; 15/165

[58] Field of Search ..... 15/169, 180, 197, 198, 15/200, 165, 21 D, 104.05, 104.17, 104.18, 104.2, 104.01 R, 104.01 P

[56] References Cited

U.S. PATENT DOCUMENTS

| | | | |
|---|---|---|---|
| 289,132 | 11/1883 | Petmecky | 15/104.18 |
| 987,277 | 3/1911 | Wright | 15/169 |
| 1,629,481 | 5/1927 | Davidson | 15/197 |
| 1,971,175 | 8/1934 | Diepold | 15/169 |
| 2,608,034 | 8/1952 | Fromson | 15/169 X |
| 3,110,053 | 11/1963 | Surabian | 15/169 X |

FOREIGN PATENT DOCUMENTS

| | | | |
|---|---|---|---|
| 1876 | of 1881 | United Kingdom | 15/169 |

*Primary Examiner*—Peter Feldman

*Attorney, Agent, or Firm*—Schwartz, Jeffery, Schwaab, Mack, Blumenthal & Koch

[57] ABSTRACT

An adjustable circular brush having a variable effective working diameter comprising a brush having radially projecting flexible bristles and an annular sleeve having a diameter less than the diameter of the bristles; the sleeve being selectively, axially movable between a first position in which the sleeve is retracted away from the bristles of the brush so that the bristles project freely in the radial direction in order to establish a maximum effective working diameter for the brush, and a second position in which the sleeve is extended to at least partially surround the brush so that the bristles are compressed in order to establish an effective working diameter for the brush which is less than the maximum effective working diameter. The brush is particularly suited for cleaning the points in the interior of a distributor cap and may be adjusted to clean various sizes of distributor caps.

15 Claims, 6 Drawing Figures

ADJUSTABLE BRUSH

BACKGROUND OF THE INVENTION

This invention relates to an adjustable brush. More particularly, this invention relates to a circular brush, the effective working diameter of which may be adjusted. In particular, this invention relates to an adjustable brush specifically adapted for cleaning the points of various sizes of distributor caps.

The distributor of a typical internal combustion engine comprises a cup-shaped member called a distributor cap which has in its interior a plurality of electrical contacts called points. Not infrequently, the electrical contacts or points will become fouled with corrosion products or foreign material. This may interfere with the proper transmission of an electrical spark to the cylinders to ignite the fuel/air mixture thereby resulting in poor operation of the engine. Thus, it becomes necessary at intervals to clean the points in the interior of a distributor cap. Most commonly, such a cleaning operation is effected by scraping the points with an instrument such as the blade of a pocket knife. Such a procedure is inefficient both from the standpoint of the time required and from the standpoint of the efficacy of the result.

Specialized tools have been proposed for cleaning distributor contacts. For Example, Ross, U.S. Pat. No. 1,188,837 discloses a device for grinding the commutators of old-fashioned distributors with a grinding wheel or disk. Similarly, Morris, U.S. Pat. No. 1,570,166 discloses a grinding tool comprising a longitudinally split wooden cylinder with a band of emery cloth around one end. The diameter of the wooden cylinder may be slightly adjusted by forcing a tapered body into a central bore in the cylinder. Such devices are manifestly unsuitable for cleaning the points of modern distributors.

Merchant, U.S. Pat. No. 2,476,156 discloses a circular brush for cleaning the terminals of a distributor. The effective working diameter of this brush is fixed so that it is only useful for a single size of distributor cap. Since distributor caps come in many different sizes, a mechanic would need an impracticably large number of different size brushes in order to have the proper size brush for cleaning each distributor cap.

Brushes with adjustable effective working diameters are known. An adjustable brush for cleaning tobacco pipes is disclosed in Pfabe, U.S. Pat. No. 1,510,499. Another adjustable brush for cleaning receptacles such as tin cans is disclosed in Rude, U.S. Pat. No. 1,308,195. Such adjustable brush designs are not suitable for cleaning the points of a distributor cap.

There remains a need for a single tool for effectively cleaning the points on the inside of a distributor cap which is readily adjustable so as to be suitable for cleaning various sizes of distributor caps.

SUMMARY OF THE INVENTION

Accordingly, it is an object of the present invention to provide a new type of adjustable brush.

Another object of the present invention is to provide a circular brush having an effective working diameter which is infinitely variable between upper and lower limits.

A further object of the present invention is to provide an adjustable brush with means for manually gripping and rotating the brush.

Yet another object of the present invention is to provide an adjustable brush useful for cleaning the points on the inside of a distributor cap.

It is also an object of the present invention to provide an adjustable brush which is useful for cleaning various sizes of distributor caps.

An additional object of the present invention is to provide an adjustable brush which can be locked in a desired position.

A still further object of the present invention is to provide an adjustable brush having means to protect the bristles of the brush during storage.

These and other objects of the invention are achieved by providing a circular brush having an adjustable effective working diameter comprising brush means having radially projecting flexible bristles and annular sleeve means having a diameter less than the diameter of the radially projecting bristles, wherein the sleeve means is selectively, axially movable between a first position in which the sleeve is retracted away from the bristles of the brush means so that the bristles project freely in the radial direction in order to establish a maximum effective working diameter for the brush, and a second position in which the sleeve means is extended to at least partially surround the brush means so that the bristles are compressed in order to establish an effective working diameter for the brush which is less than the maximum effective working diameter.

In some of its preferred aspects the adjustable brush of the present invention is provided with handle means for facilitating manual gripping and rotation of the brush, and the handle means comprise a pair of transversely oriented grip members, one of the grip members being rigidly connected to the brush means and the other of the grip members being rigidly connected to the sleeve means, and the grip members being selectively moveable relative to each other whereby the relative position of the brush means and the sleeve means can be controlled. In a further preferred aspect of the presently claimed invention, guide means are provided to maintain alignment of the brush means and the sleeve means comprising a guide rod fastened to one of said brush means or sleeve means which guide rod telescopes into a receiving tube mounted on the other of said guide means or sleeve means, and the guide means further comprises a pair of guide bars secured to the sleeve means which guide bars engage handle means connected to the brush means. In yet another preferred aspect, the presently claimed invention comprises locking means, such as a thumbscrew assembly, for locking the adjustable brush assembly in a desired position.

BRIEF DESCRIPTION OF THE DRAWINGS

The invention will be explained in further detail with reference to the accompanying drawings wherein.

DETAILED DESCRIPTION OF A PREFERRED EMBODIMENT

Figure 1:
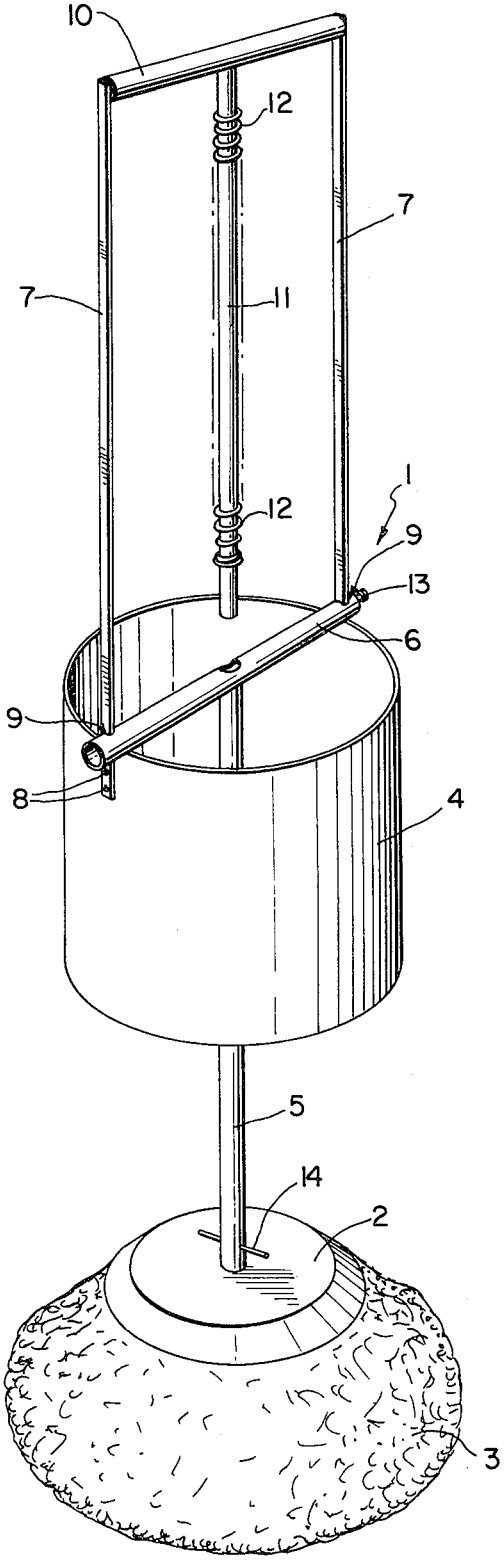
FIG. 1 is a perspective view of an adjustable brush according to the presently claimed invention.

FIG. 1 is a perspective view of an adjustable brush according to the present invention generally designated by reference numeral 1. Brush 1 comprises a circular brush 2 with radially projecting bristles 3. Brush 1 further comprises an annularly aligned cylindrical sleeve 4. Brush 2 is rigidly connected to a handle assembly comprising an axially oriented guide tube 5 and a transverse grip member 6 secured to the end of guide tube 5.

Sleeve 4 is rigidly connected to a pair of guide bars 7 by means of rivets 8. Guide bars 7 extend upwardly through a pair of guide openings 9 which extend through transverse grip member 6. The upper ends of guide bars 7 are joined by a second transverse grip member 10. Depending from the center of transverse grip member 10 is an axial guide rod 11 designed to be received telescopically within axial guide tube 5, as seen more particularly in FIG. 2. Coaxial alignment of brush 2 and sleeve 4 are maintained by the combined action of guide rod 11 and guide tube 5 and of guide bars 7 and guide openings 9. Sufficient clearance is provided between the exterior of guide rod 11 and the interior of guide tube 5 and between guide bars 7 and the sides of guide openings 9 to permit free movement so that sleeve 4 may be extended toward brush 2 by drawing the transverse grip members 6 and 10 toward each other.

A compression spring 12 is provided around guide rod 11. Spring 12 urges grip members 6 and 10 away from each other and acts to retract sleeve 4 away from brush 2 when the grip members are released.

A locking mechanism is also provided to enable sleeve 4 and brush 2 to be secured in a desired position with respect to each other. In the illustrated embodiment, this locking means takes the form of the thumbscrew 13 mounted in the end of transverse grip member 6. By tightening thumbscrew 13 until the end of the screw engages the adjacent guide bar 7, relative motion between sleeve 4 and brush 2 may be prevented. Sleeve 4 and brush 2 may thus be locked in any desired position with respect to each other.

Figure 2:
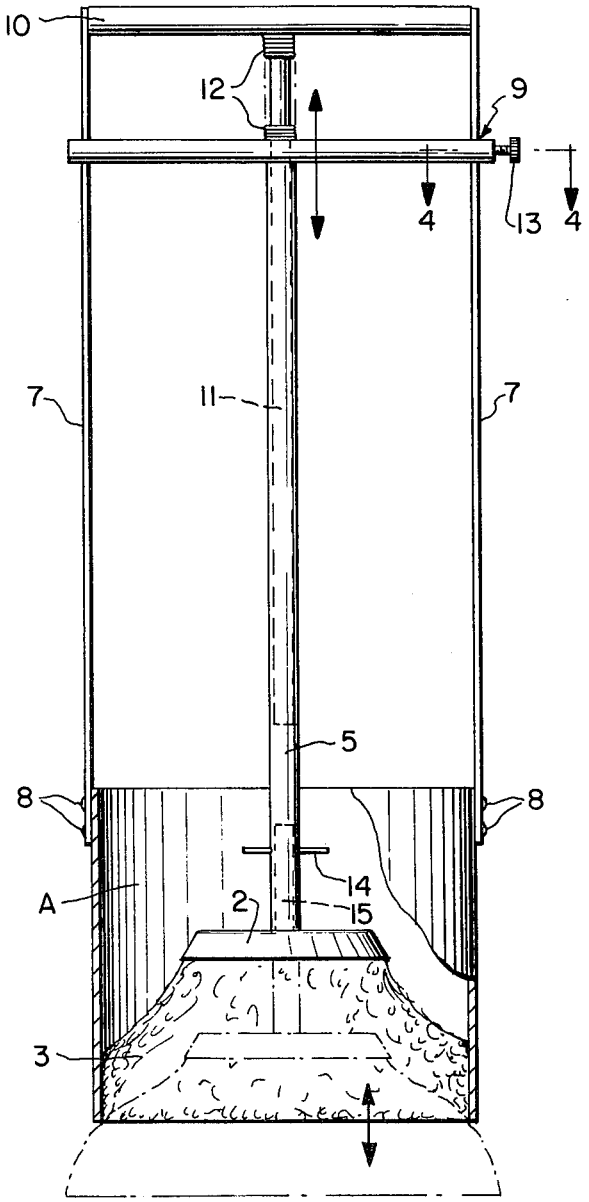
FIG. 2 is a side elevational view in partial section of the brush of FIG. 1.

As seen more clearly from FIG. 2, brush 2 is releasably connected to guide tube 5 by means of a connecting pin 14 which extends through guide tube 5 and axial shaft 15 of brush 2. By removing pin 14, brush 2 may be released from guide tube 5. This arrangement facilitates replacement of a worn brush with a new brush or substitution of one brush for another differing in size or materials of construction.

Figure 3:
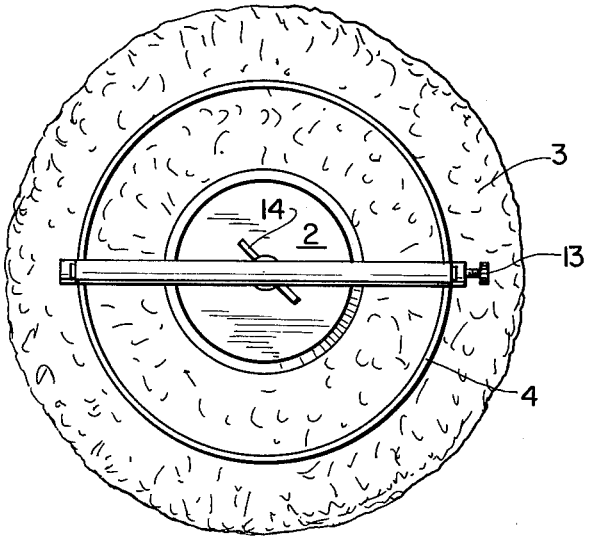
FIG. 3 is a top plan view of the brush of FIGS. 1 and 2.
Figure 4:
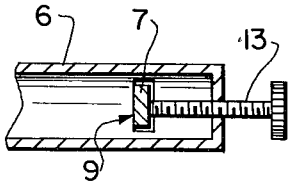
FIG. 4 is an enlarged detail sectional view taken along line 4—4 of FIG. 2.

As can be seen most clearly from FIG. 3, the diameter of sleeve 4 is less than the diameter of the radially projecting bristles 3 of brush 2. When sleeve 4 is retracted away from brush 2, the bristles project freely to establish a maximum effective working diameter for the adjustable brush. When sleeve 4 is extended to surround brush 2, bristles 3 are compressed, and the effective working diameter of the brush is reduced. As seen in FIG. 2, sleeve 4 may be extended to completely surround brush 2 so as to protect bristles 3 from damage during storage or transportation.

The brush of the invention is particularly adapted for use in cleaning corrosion or foreign material from the points in the interior of a distributor cap. For this purpose brush 3 may be a wire brush with steel wire bristles. If desired, a synthetic fiber brush with bristles formed of materials such as nylon or polyester might also be utilized. The remainder of the adjustable brush of the invention is advantageously constructed of metal, although rigid synthetic polymer materials could also be utilized for some or all of the parts.

If desired, the lower end of sleeve 4 could be tapered or flared slightly outwardly to facilitate extension of sleeve 4 around brush 2.

Figure 5:
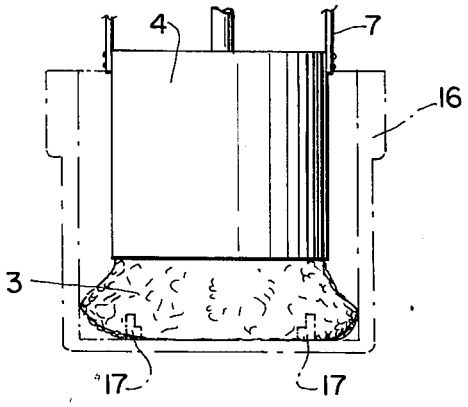
FIG. 5 is a side view of the brush of the invention with the sleeve means extended to partially surround the brush means.

FIG. 5 depicts the brush of the invention with sleeve 4 extended to partially surround the brush. It can be seen from the drawing that bristles 3 of the brush are partially compressed, whereby the effective working diameter of the brush is reduced. By appropriately positioning sleeve 4 and brush 2 with respect to each other, the effective working diameter of the brush can be adjusted so that it will fit into a distributor cap 16 (shown in phantom lines) in order to clean the points 17 in the interior of the distributor cap.

Figure 6:
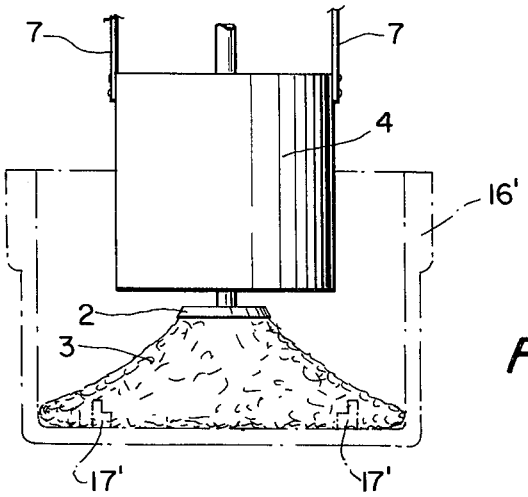
FIG. 6 is a side view of the brush of the invention with the sleeve means retracted away from the brush means.

FIG. 6 depicts the brush of the invention with sleeve 4 retracted away from brush 2. Bristles 3 thus are promitted to project freely in a radial direction so that the effective working diameter of the brush is maximumized. The larger effective working diameter of the brush as depicted in FIG. 6 enables it to used to clean the points 17′ of a larger distributor cap 16′.

Brush 2 may assume a variety of configurations. For example, brush 2 may be a substantially flat brush with all of the bristles projecting in a generally radial direction. Alternately, brush 2 may be a semi-hemispherical brush as illustrated in the drawings with bristles projecting both radially and axially.

In use, the handle means are grasped by the hand of the user, and the grip members are squeezed together against the force of the spring until the effective working diameter of the brush is adjusted to fit a desired size of distributor cap. The thumbscrew assembly is then tightened to lock the adjustable brush in the desired position. The brush is thereafter inserted into the interior cavity of the distributor cap and rotated or merely twisted back and forth. The action of the bristles of the brush against the points in the interior of the distributor cap removes any corrosion products or foreign material which may hinder the establishment of a good electrical connection between the distributor rotor and the points of the distributor cap. After a few brief turns of the brush assembly, the brush is withdrawn and any loose particulate matter is blown or wiped out of the distributor cap. The cap is now cleaned and ready for reinstallation.

Desirably, after use, the thumbscrew assembly will be released. The spring will then push the grip members to their maximum separation so that the sleeve means is retracted away from the brush means, and the bristles of the brush are allowed to project freely to their maximum effective working diameter.

Alternately, the grip members can be pulled together against the force of the spring to their position of minimum separation so that the sleeve means is forced over the brush means to a position where the bristles of the brush are completely surrounded by the sleeve. The thumbscrew assembly can then be retightened to lock the brush in such position. In this position, the bristles of the brush are protected against damage during shipment or storage of the device.

The foregoing preferred embodiment has been described solely as an example of the invention and is not intended to be limiting. Since modifications of the disclosed embodiment incorporating the spirit and substance of the invention may occur to persons skilled in the art, the scope of the invention is to be limited solely by the scope of the appended claims.

I claim:

1. A circular brush having an adjustable effective working diameter comprising brush means having radially projecting flexible bristles and annular sleeve means having a diameter less than the diameter of said radially projecting bristles, said sleeve means being selectively, axially movable between a first position in which said sleeve means is retracted away from the bristles of said brush means whereby said bristles project freely in the radial direction to establish a maximum effective working diameter for said brush means, and a second position in which said sleeve means is extended to at least partially surround said brush means whereby said bristles are at least partially compressed to establish an effective working diameter for said brush means which is less than said maximum effective working diameter, and handle means for facilitating manual grasping and rotation of said brush, wherein said handle means comprises a pair of transverse grip members, one of said grip members being rigidly connected to said brush means and the other of said grip members being rigidly connected to said sleeve means, said grip members being selectively movable relative to each other whereby the relative position of said brush means and said sleeve means can be selectively controlled.

2. A device according to claim 1 further comprising means for automatically retracting said sleeve means to said first position.

3. A device according to claim 2 wherein said automatic retracting means comprise a compression spring.

4. A device according to claim 1 further comprising means for locking said sleeve means in a desired position intermediate said first and second positions to establish an effective working diameter intermediate the maximum effective working diameter and the effective working diameter when said sleeve means is in said second position.

5. A device according to claim 4 wherein said locking means comprises a thumbscrew mechanism for locking a handle member connected to one of said brush means and sleeve means in a fixed position with respect to a guide member connected to the other of said brush means and sleeve means.

6. A device according to claim 1 further comprising means for selectively releasing said brush means from said device.

7. A device according to claim 1 wherein substantially all of the bristles of said brush means project in a generally radial direction.

8. A device according to claim 1 wherein said brush means comprises a semi-hemispherical brush.

9. A device according to claim 1 wherein said sleeve means is movable to a storage position in which the bristles of said brush means are completely surrounded by said sleeve means.

10. A device according to claim 1 wherein the end of said sleeve means adjacent said brush means is beveled to facilitate extending said sleeve means to a position at least partially surrounding said brush means.

11. A device according to claim 1 wherein said brush means comprises a wire brush.

12. A device according to claim 1 wherein said brush means comprises a synthetic bristle brush.

13. A device according to claim 1 wherein said sleeve means may be selectively positioned at any position intermediate said first position and said second position in order to vary the effective working diameter of said brush means.

14. A circular brush having an adjustable effective working diameter comprising brush means having radially projecting flexible bristles and annular sleeve means having a diameter less than the diameter of said radially projecting bristles, said sleeve means being selectively, axially movable between a first position in which said sleeve means is retracted away from the bristles of said brush means whereby said bristles project freely in the radial direction to establish a maximum effective working diameter for said brush means, and a second position in which said sleeve means is extended to at least partially surround said brush means whereby said bristles are at least partially compressed to establish an effective working diameter for said brush means which is less than said maximum effective working diameter, and guide means for maintaining the alignment of said brush means and said sleeve means, said guide means comprising a pair of guide bars connected to said sleeve means, a handle means connected to said brush means to facilitate manipulation of said brush means, and guide openings formed in said handle means, said guide bars being received through said openings in said handle means, said openings being axially aligned so that said handle means slides longitudinally along said guide bars.

15. A circular brush having an adjustable effective working diameter comprising brush means having radially projecting flexible bristles and annular sleeve means having a diameter less than the diameter of said radially projecting bristles, said sleeve means being selectively, axially movable between a first position in which said sleeve means is retracted away from the bristles of said brush means whereby said bristles project freely in the radial direction to establish a maximum effective working diameter for said brush means, and a second position in which said sleeve means is extended to at least partially surround said brush means whereby said bristles are at least partially compressed to establish an effective working diameter for said brush means which is less than said maximum effective working diameter, and guide means for maintaining the alignment of said brush means and said sleeve means, said guide means comprising a central guide rod on said sleeve means, a guide tube aligned with said guide rod mounted on said brush means, said guide rod being telescopically received in said aligned guide tube such that said guide rod extends out of only one end of said guide tube whereby the effective length of said guide means can be varied by moving said guide rod into and out of said guide tube, and a handle connected to the top of said guide rod.

* * * * *